US008109096B2

(12) United States Patent
Schaeffer

(10) Patent No.: US 8,109,096 B2
(45) Date of Patent: Feb. 7, 2012

(54) METHOD FOR PRODUCTION OF MIXED VAPOUR

(75) Inventor: Bernhard Schaeffer, Berlin (DE)

(73) Assignee: LESA Maschinen GmbH, Berlin (DE)

( * ) Notice: Subject to any disclaimer, the term of this patent is extended or adjusted under 35 U.S.C. 154(b) by 429 days.

(21) Appl. No.: 12/312,135

(22) PCT Filed: Oct. 26, 2007

(86) PCT No.: PCT/EP2007/009515

§ 371 (c)(1),
(2), (4) Date: Apr. 27, 2009

(87) PCT Pub. No.: WO2008/052787

PCT Pub. Date: May 8, 2008

(65) Prior Publication Data

US 2010/0058762 A1 Mar. 11, 2010

(30) Foreign Application Priority Data

Oct. 28, 2006 (DE) ..... 102006050967

(51) Int. Cl.

| | |
|---|---|
| ***F01K 25/08*** | (2006.01) |
| ***F01K 3/00*** | (2006.01) |
| ***F01K 5/00*** | (2006.01) |
| ***F01K 7/00*** | (2006.01) |
| ***F01K 25/06*** | (2006.01) |
| ***F01K 25/00*** | (2006.01) |

(52) U.S. Cl. ..... 60/651; 60/509; 60/671; 60/649

(58) Field of Classification Search ..... 60/509, 60/649, 651, 671, 673

See application file for complete search history.

(56) References Cited

U.S. PATENT DOCUMENTS

| | | | | |
|---|---|---|---|---|
| 2,215,497 | A * | 9/1940 | Doczekal | 60/648 |
| 4,448,025 | A | 5/1984 | Oda | |
| 4,729,226 | A | 3/1988 | Rosado | |
| 4,945,725 | A * | 8/1990 | Carmein et al. | 60/509 |

FOREIGN PATENT DOCUMENTS

| | | |
|---|---|---|
| AT | 155744 | 3/1939 |
| DE | 103 56 738 | 8/2005 |
| WO | WO-2005/054635 | 6/2005 |

* cited by examiner

*Primary Examiner* — Thomas Denion
*Assistant Examiner* — Christopher Jetton
(74) *Attorney, Agent, or Firm* — Jordan and Hamburg LLP

(57) ABSTRACT

Method for production of mixed vapors at low temperatures. The thermal energy stored in the mixed vapors is intended to be converted to mechanical energy in a thermal power machine, in order to operate an electrical generator.

9 Claims, 1 Drawing Sheet

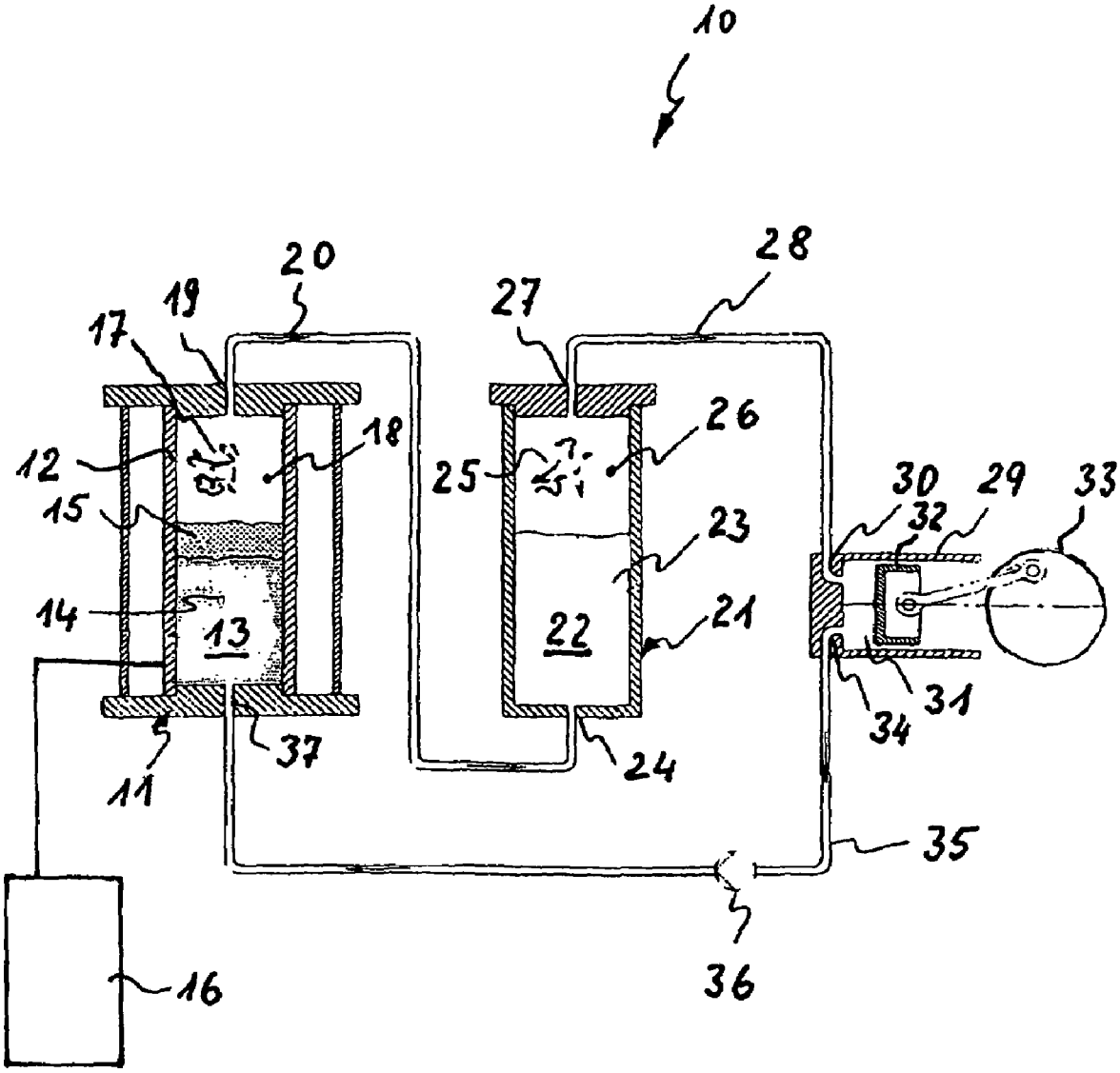
10
20
28
19
27
17
18
26
12
25
30
29
33
15
32
23
14
13
22
21
31
34
37
24
11
35
36
16

METHOD FOR PRODUCTION OF MIXED VAPOUR

BACKGROUND OF THE INVENTION

The invention relates to a method for production of mixed vapor.

The physical processes described in the following relate to heat engines that are operated with mixed vapor in a cyclical process. Applicable physical phenomena and laws are sufficiently known from thermodynamics. Their fundamentals shall not be explained in greater detail here.

Heat engines are normally operated with vapor. To produce vapor, liquids are subjected to high pressure in a vapor generator and evaporated by adding energy. This vapor can then be converted to mechanical energy.

It has been demonstrated that the efficiency of heat engines can be improved provided they are operated with mixed vapors. AT 155744 describes the production of mixed vapor from two or more polar and non-polar liquids that re-separate in the liquid phase.

The mixed vapor is brought to a complete or partial liquid state using one or more successive expansions and compressions during work output. Then the mixed vapor is re-evaporated when heat is added and returned to the work process. The work that is released during this can be used for producing electrical energy.

Also known are methods for producing mixed vapors and heat engines with which mixed vapors can be converted to mechanical energy. Publication DE 103 56 738 A1 describes one such method for producing mixed vapors.

Publication U.S. Pat. No. 4,729,226 discloses a method for producing mechanical energy using mixed vapors.

Publication U.S. Pat. No. 4,448,025 describes a method in which the exhaust heat is used for heating the working medium.

Moreover, publication WO 2005/054635 A2 discloses a method for producing mechanical energy in a cyclical process with a working medium that comprises two components that have very different boiling points.

With these, the high mixed vapor temperatures and working pressures in the vapor generators and lines are disadvantageous. This results in particularly high demands on the materials used. Such systems are made of high-qualify special steels in order to ensure their operating safety. They also need to be thoroughly and regularly checked by trained personnel. All of this is time-consuming and associated with high costs.

Furthermore, producing a mixed vapor with which it is possible to operate a heat engine with adequate output requires a significant amount of energy. The evaporation energy required comes almost exclusively from fossil fuels.

SUMMARY OF THE INVENTION

The object of the present invention is to create a method for producing mixed vapor, with which method it is possible to improve efficiency and to reduce the amount of energy used, the operating temperature, and the operating pressure.

This object is attained using a method in accordance with claim 1, in particular using the following method steps:

- Producing a mixed vapor in a first pressure chamber from a non-polar fluid and a polar fluid at a low temperature;
- Adding the mixed vapor to a downstream enriching vessel including a second pressure chamber and enriching it with polar fluid at slightly higher temperatures;

- Compressing the enriched mixed vapor by means of a heat engine;
- Adiabatically expanding the mixed vapor to create wet vapor, the polar fluid condensing and the heat released thereby being output to the non-polar fluid;
- Transferring the work released during the adiabatic expansion of the mixed vapor to the heat engine for producing electrical energy;
- Returning the expanded wet vapor to the first pressure chamber.

Using these measures provides a method with which it is possible to employ renewable energies for operating heat engines economically and cost-effectively while simultaneously increasing efficiency. Thus for instance current can be produced that can be profitably supplied to a public electric power system. With it a heat engine can be operated in a cost-effective, energy-efficient, profitable, and resource-saving manner. Work released by a beat engine operated in accordance with the invention can be transmitted to a crank mechanism that produces a rotational movement. The rotational movement can be transmitted to an alternator for producing electrical energy.

BRIEF DESCRIPTION OF THE DRAWINGS

The drawing is a schematic representation of an apparatus suitable for performing the method of the invention. The exemplary apparatus shall be described in greater detail in the following.

DETAILED DESCRIPTION OF THE INVENTION

The apparatus 10 depicted in the sole FIGURE essentially comprises at least one mixed vapor generator 11 that is provided with a low pressure vessel 12. The low pressure vessel 12 has a first pressure chamber 13 in which a first polar fluid 14, for instance water, and at least one non-polar fluid 15, for instance benzene, are present in liquid form. There is preferably a greater quantity of the polar fluid 14 than the non-polar fluid 15.

A heat exchanger 16, for instance any desired boiler system (schematically depicted), is associated with the mixed vapor generator 11. This heat exchanger 16 can act on and evaporate the fluids 14 and 15.

The heat exchanger 16 is operated with solar energy or geothermal energy. It is also possible to use renewable energy sources such as wood, for instance in the form of wood chips from first product leftovers. Any other type of biomass is also conceivable, provided it is present in an appropriate quality and quantity for being converted to heat energy.

The mixed vapor generator 11 is operated at a temperature in the range of 50° C. to 75° C. and at a pressure in the range of 0.5 to 1.5 bar. A mixed vapor 17 is produced from the polar fluid 14 and the non-polar fluid 15. The mixed vapor 17 produced in this manner is collected in a vapor pressure chamber 18 of the mixed vapor generator 11.

The collected mixed vapor 17 is then conducted through a mixed vapor outlet 19 via a line 20 into a downstream enriching vessel 21. The enriching vessel 21 has a second pressure chamber 22 that is partly filled with a second polar fluid 23. The second polar fluid 23 is chemically identical to the first polar fluid 14; its temperature is merely higher compared to the mixed vapor 17 being introduced.

The second polar fluid 23 preferably has a temperature in the range of 70° C. to 95° C., the pressure in the enriching vessel 21 being in the range of 0.5 to 1.5 bar. The pressures in the pressure chambers 13 and 22 are preferably the same. The mixed vapor 17 in the second pressure chamber 22 is conducted through the second polar fluid 23 that is present as a liquid.

When it passes through the second polar fluid 23 that is at a higher temperature, the mixed vapor 17 is enriched with polar fluid and is collected in a second vapor pressure chamber 25 as an enriched, dry mixed vapor 24 preferably at a temperature in the range of 70° C. to 95° C.

The dry mixed vapor 24 enriched in this manner is conducted via a mixed vapor outlet 26 and a line 27 to a heat engine 28. The enriched, dry mixed vapor 24 in the line 27 is now conducted to the working chamber 30 of a heat engine 28 via an inlet 29 for condensation.

Condensation brings the dry mixed vapor 24 to a substantially higher temperature, preferably approx. 180° C. Once it has reached this temperature, the enriched, dry mixed vapor 24 is adiabatically expanded, creating wet vapor. The expanded wet vapor travels through an outlet 31 into a return line 32 and is conducted back to the first pressure chamber 13 via a non-return valve 33 and a return inlet 34. Now the vapor cycle can begin all over again.

The invention claimed is:

1. Method of producing mixed vapor for operating a heat engine, comprising:

producing a mixed vapor in a first pressure chamber from a non-polar fluid and a polar fluid at a low temperature;

enriching the mixed vapor with a polar fluid at a slightly higher temperature in a downstream enriching vessel comprising a second pressure chamber;

compressing the enriched mixed vapor by means of a heat engine;

adiabatically expanding the mixed vapor to create wet vapor, the polar fluid condensing and heat released thereby being output to the non-polar fluid;

transferring work released during the adiabatic expansion of the mixed vapor to the heat engine; and returning the expanded wet vapor to the first pressure chamber.

2. Method in accordance with claim 1, wherein the polar fluid comprises water and the non-polar fluid comprises benzene.

3. Method in accordance with claim 1, wherein the polar and non-polar fluids evaporate at low temperatures.

4. Method in accordance with claim 1, wherein the mixed vapor is produced by applying solar energy, geothermal energy, or heat of combustion of a biomass to heat the fluids to their respective vaporization temperatures.

5. Method in accordance with claim 1, wherein the mixed vapor produced in the first pressure chamber has a temperature of 50° C. to 75° C.

6. Method in accordance with claim 1, wherein the enriched mixed vapor has a temperature of 70° C. to 95° C.

7. Method in accordance with claim 1, wherein the enriched mixed vapor is dry.

8. Method in accordance with claim 1, further comprising transmitting work that is released by the heat engine to a crank mechanism that produces a rotational movement.

9. Method in accordance with claim 8, further comprising transmitting the rotational movement to an alternator thereby to produce electrical energy.

* * * * *